United States Patent [19]

Seas

[11] Patent Number: 4,914,060

[45] Date of Patent: Apr. 3, 1990

[54] CONNECTOR FOR ANTENNAS AND COAXIAL CABLE

[76] Inventor: James A. Seas, 3629 Whetstone River Rd. South, Marion, Ohio 43302

[21] Appl. No.: 325,451

[22] Filed: Mar. 17, 1989

[51] Int. Cl.[4] ..... H01R 13/54

[52] U.S. Cl. ..... 439/318; 439/314

[58] Field of Search ..... 439/314, 315, 316, 317, 439/318, 319, 271, 272, 273, 277, 916

[56] References Cited

U.S. PATENT DOCUMENTS

| | | | |
|---|---|---|---|
| 1,602,221 | 10/1926 | Godley | 439/320 |
| 2,400,351 | 5/1946 | Hart | 439/314 |
| 3,750,087 | 7/1973 | Vetter | 439/318 |
| 3,976,352 | 8/1976 | Spinner | 439/272 X |
| 4,068,911 | 1/1978 | Lodato et al. | 439/319 |
| 4,165,910 | 8/1979 | Anderson | 439/318 |
| 4,168,105 | 9/1979 | Herrmann, Jr. | 439/319 |
| 4,180,301 | 12/1979 | Hutter | 439/271 |
| 4,445,743 | 5/1984 | Bakker | 439/314 |
| 4,462,653 | 7/1984 | Flederbach et al. | 439/314 X |
| 4,464,001 | 8/1984 | Collins | 439/318 |
| 4,611,213 | 9/1986 | Johnson et al. | 439/578 |
| 4,648,670 | 3/1987 | Punako et al. | 439/312 |

FOREIGN PATENT DOCUMENTS

| | | | |
|---|---|---|---|
| 2024369 | 11/1970 | Fed. Rep. of Germany | 439/314 |
| 1401373 | 7/1975 | United Kingdom | 439/314 |

*Primary Examiner*—William Briggs

*Attorney, Agent, or Firm*—Mueller and Smith

[57] ABSTRACT

A quick disconnect form of connector for antennas and coaxial cables serves to provide a highly rigid coupling with no relative movement between connector components. The springless device utilizes a clamp component which is threadably engaged with a nylon sleeve. The sleeve is configured having an internal passageway which passes over a conventional fixed bayonet type connector and incorporates internal ramps which engage the bayonet pins of the connector upon rotation of the sleeve. A contact shoulder is provided internally of the sleeve which is engaged with the antenna supporting clamp and compressively urged against the end surface of the fixed bayonet connector. The result is to tighten the sleeve ramp surface against the bayonet pins to achieve a very rigid connection. The integrity of this rigid connection is enhanced by the utilization of a polyamide material for the sleeve which is deformed by the bayonet pins of the bayonet type fixed connector.

11 Claims, 4 Drawing Sheets

CONNECTOR FOR ANTENNAS AND COAXIAL CABLE

BACKGROUND OF THE INVENTION

Portable radio transmission and reception equipment typically is configured for convenient carrying by operational personnel working remotely from a central communications control station. Generally, such remote use subjects the portable transmission-reception devices to a substantial amount of wear and environmental abuse. To enhance the portability and robustness of such devices, the necessary antenna mount now most popular is formed as a helical spring, the outer periphery of which is protected by a polymeric cover such as a "shrink wrap" sheath.

Because the small receiver-transmitters are serviced from time to time, and in view of the vulnerability of the small aerials to being otherwise contorted and abused during use, a convenient, removable form of connection serving both mechanical and electrical needs is employed for antenna attachment to the portable radio housings. Generally, an inexpensive and widely accepted "BNC" or bayonet type connector is employed to achieve this removability requirement. This connectors include a cylindrical base or shell portion which is rigidly coupled with the radio housing by a hex nut or the like and within which is mounted a dielectric surrounded tubular female connector. Forming part of the removable connector shell are two oppositely disposed bayonet pins or studs which extend outwardly from the shell surface a small distance.

Mounted upon the lower portion of the helical spring antenna is a dielectric surrounded male coaxial connector which, in turn, is surrounded by a rotatably mounted coupling section having a knurled hand graspable surface and an integrally formed outer body containing two oppositely disposed diagonal slots, each terminating in a circular shaped detent. An Annular spring member within the assemblage biases this body member toward the spring antenna thereto such that a spring generated release permits sufficient relative movement between the two principal coupling pieces to achieve a bayonet pin movement into the noted detent.

While the noted BNC type connector achieves a desirable "quick disconnect" feature, the spring biasing arrangement performing in conjunction with the noted ramp and detent approach permits a relative movement between the two connector pieces. This small amount of play or motion tends to permit a loosening of the connection over a period of use engendering unwanted interference or noise and the like detracting from transmission and reception by the devices. Additionally, the non-rigid form of coupling has been seen to promote a wear and failure of the connection at a pace for most applications which is considered excessive.

The same form of wear and distortion has been witnessed in closely analogous connectors for coupling one coaxial cable to another in electrical equipment. With such cables, two transmission paths are involved instead of one as is typical with antenna mounts. However, the same form of deficiencies tend to occur, spurious noise generating movement due to wear occurring over the lifespans of the equipment with which they are intended to be used.

SUMMARY

The present invention is addressed to a connector for antennas and coaxial cables which, while remaining simple and fabricable on a cost efficient basis, achieves a rigid and secure mount between a transmission component and the device to which it is attached. With the inventive connector, a clamp structure is combined with a polymeric sleeve to form an easily derived compression characterized attachment geometry. By employing a polymeric material for the noted sleeve structure, a deforming engagement with fixed connector engaging components such as bayonet pins and the like may be derived to enhance the integrity of the coupling against vibratory and shock phenomena.

Another feature of the invention is to provide an electrical connector for connecting a wire containing electrical transmission device to a complementary connector fixed to the housing of another electrical device having an end surface and engaging components for restraining the connector from upward movement. The connector includes an electrical lead having a pin connector portion electrically connectable with the transmission device for electrical connection with the complementary connector. A support assembly is provided for supporting the electrical lead, having a coupling portion and a contact shoulder. Further, a sleeve arrangement is mountable over the complementary connector, removably engageable with the engaging components, and includes an engaging region connectable with the support assembly coupling portion for effecting a compression, non-yielding engagement between the support assembly contact shoulders and the complementary connector end surface.

Another feature of the invention provides a connector for mounting an electrical transmission component to a bayonet-type fixed connector having a cylindrical support shell, and end surface, oppositely disposed bayonet pins and surrounding a centrally-disposed conductive receiver. The connector includes a support clamp having a rearwardly disposed support portion for supporting the electrical transmission component, a coupling portion adjacent thereto, a compression shoulder and a conductor lead arrangement electrically communicating with the transmission component for removable connection with the conductive receiver. A spacer is included having a compression surface configured for receiving the compression shoulder in force transmitting communicating and an oppositely-disposed contact shoulder. A connector sleeve is provided having a cylindrical passageway extending therethrough, the connector sleeve being configured having an engaging region for receiving and engaging the support clamp coupling portion in compression-deriving connection upon relative movement therebetween. The passageway of the sleeve includes an internally disposed ramp arrangement having oppositely disposed ramp contact surfaces for engagement with the bayonet pins and a channel or slot arrangement for accessing the bayonet pins with the ramp contact surfaces upon positioning of the clamp passageway over the fixed connector cylindrical support, the channel arrangement extending to an end surface of the sleeve. With the arrangement, the connector sleeve, upon rotation, is drawn toward the bayonet-type fixed connector by the connector sleeve ramp contact surfaces engagement with the bayonet pin to effect connection of the fixed connector conductive receiver and the conductive lead, and upon relative movement of the support clamp and the connector sleeve, the ramp contact surfaces and the bayonet pins are urged into compressive engagement.

Other objects of the invention will, in part, be obvious and will, in part, appear hereinafter.

The invention, accordingly, comprises the apparatus possessing the construction, combination of elements, and arrangement of parts which are exemplified in the following detailed disclosure. For a fuller understanding of the nature and objects of the invention, reference should be had to the following detailed description taken in connection with the accompanying drawings.

DETAILED DESCRIPTION OF THE INVENTION

Figure 1:
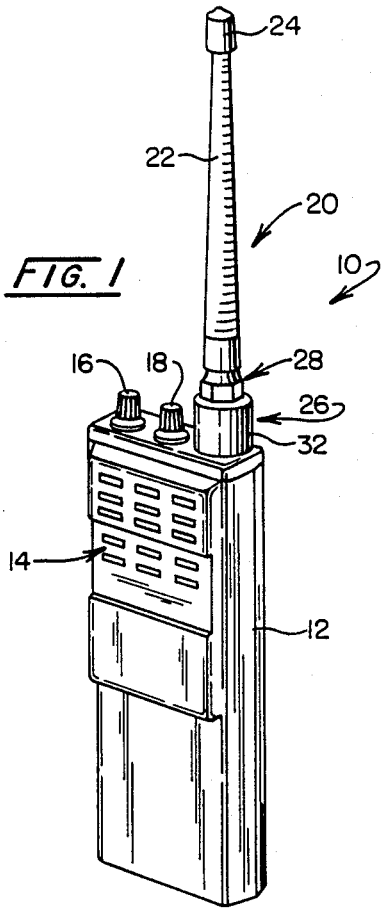
FIG. 1 is a perspective view of a portable radio employing an antenna connector according to the invention.
Figure 2:
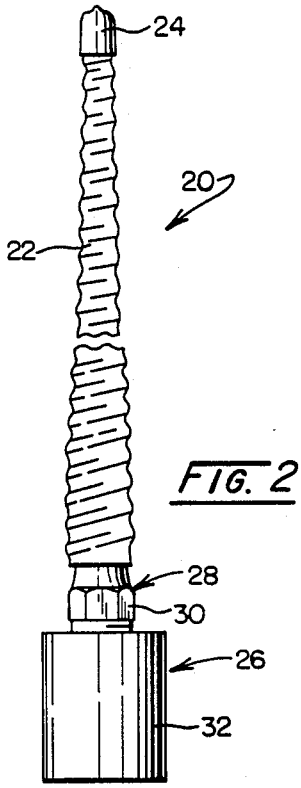
FIG. 2 is a front view of an antenna incorporating the connector of the invention with a portion broken away.
Figure 3:
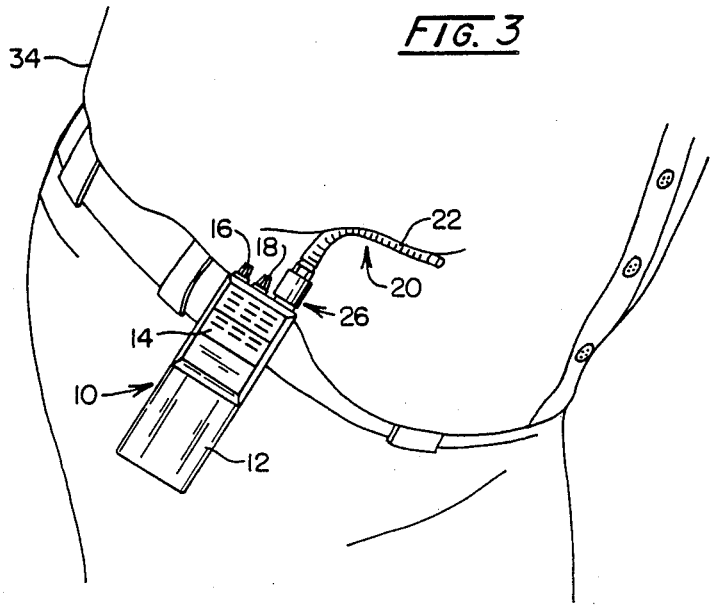
FIG. 3 is a front view of the radio of FIG. 1, the antenna thereof being contorted as represented by the silhouette of a human anatomy.

Referring to FIG. 1, a personal radio intended to be hand carried by field personnel is represented generally at 10. Formed having a housing 12 of component and somewhat elongate shape, the ratio 10 provides for transmission and reception of communications, and thus includes transmission and reception components at region 14 thereof, as well as hand manipular controls such as are represented by knobs 16 and 18. Protruding or extending upwardly from the housing 12, in conventional fashion, is an antenna represented generally at 20 which includes a helically shaped spring type conductive component 22 which typically is covered with a polymeric material such as a "shrink wrap". A cap 24 is positioned at the top of this assemblage and it is the connector represented generally at 26 with which the instant invention is concerned. As shown in FIG. 2, the connector 26, from an external viewpoint, is seen to include a support clamp represented generally at 28 having a polygonal tool surface region 30 and a cylindrical connector sleeve 32. The connector 26 functions to very securely affix the antenna 20 to the housing 12 such that the flexible and spring type antenna body 22 may be subjected to many forms of flexure, impact, and the like, for which it is aptly designed, while not adversely affecting this necessary association with the circuit of housing 12 through connector 26. As represented in FIG. 3, such devices 10 often are carried upon a belt or the like by field personnel as represented in silhouette at 34. Movement of the human anatomy will impose flexure upon the antenna 20 which are accommodated for by the connector 26 of the invention.

Figure 4:
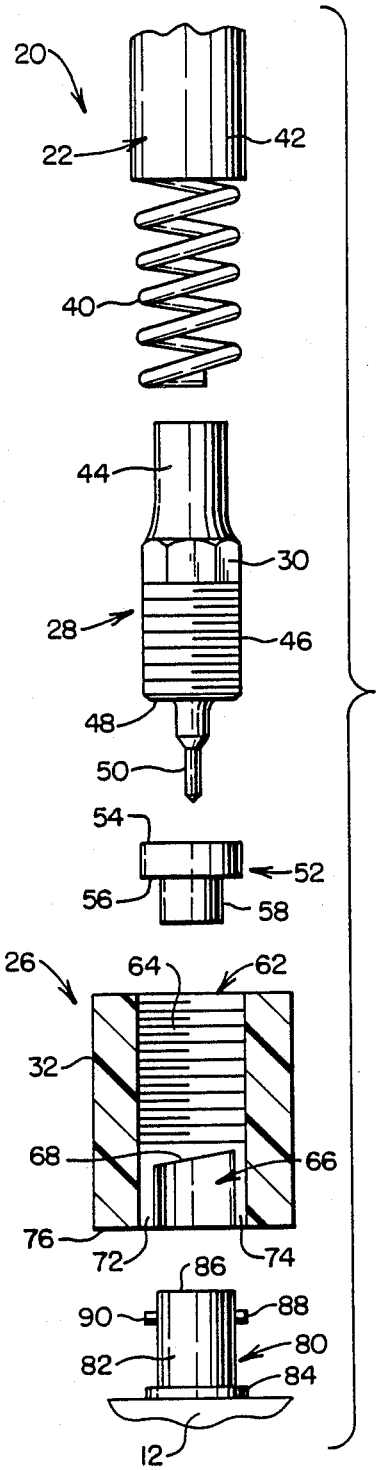
FIG. 4 is an exploded view of one embodiment of a connector according to the invention.

Referring to FIG. 4, the connector 26 is revealed in exploded fashion. In the figure, the lower portion of the helical spring component of the antenna is shown to include a helically formed antenna wire 40 over which is positioned a polymeric cover 42 which may be of a "shrink wrap" variety. The lower portion of wire antenna 40 is coupled to support clamp 28 at the upwardly or rearwardly disposed support portion 44 thereof. Connection may be by employing ridges within portion 44 to engage the helical component 40, the connection being further buttressed by brazing, soldering, or the like. The metal clamp 28 further includes an integrally formed tool engagement surface 30 which may, for example, be of a polygonal geometry such as hexagonal providing for facile connection thereof with a wrench or the like. Extending from the tool engagement surface 30 is a cylindrical coupling portion 46 which carries externally disposed threads and extends to a compression shoulder 48 of circular periphery. From the compression shoulder 48 there is shown protruding a conductor lead 50 having the form of a rigid pin.

The next sequential component in the connector 26 assemblage is a spacer represented generally at 52 which, for example, may be formed of an electrically insulative polymeric material such as a polyamide and which includes a centrally-disposed cylindrical passageway (not shown) for nestably receiving the conductive lead assemblage 50. Spacer 52 is formed having a compression surface 54 and an oppositely disposed contact shoulder 56 as well as an aligning collar 58 extending therefrom.

Next in the sequence of components is the noted connector sleeve 32 which may, for example, be formed of an electrically insulative polymeric material such as a polyamide popularly marketed under the trade designation "Nylon". Connector sleeve 32 forms part of a support assembly with support clamp 28 and is of generally cylindrical shape, including a centrally-disposed cylindrical passageway 62 at the upper surface of which is located an engaging region 64, which is threaded to achieve threadable engagement with the corresponding threads of coupling portion 46 of clamp 28. The lower region of passageway 62 is configured to define two integrally formed oppositely disposed circular ramps represented generally at 66 and having corresponding ramp contact surfaces, one of which is revealed in the figure at 68. Communicating with these ramps 66 are two oppositely disposed slots or channels 27 and 74. Finally, the sleeve 32 is seen to terminate in an annular end surface 76.

The assemblage thus shown connects the antenna 20 with a conventional bayonet type fixed connector represented generally at 80 and including a cylindrical support shell 82 extending from an integrally formed flange 84 to an annular shaped end surface 86. Additionally formed with the connector 80 are two oppositely disposed bayonet pins or ears 88 and 90. Within the hollow shell 82 there is positioned a centrally disposed conductive receiver which typically is enclosed within a dielectric sheath and is configured in female form to receive the conductive lead or pin 50 extending from the clamp 28 upon mounting of the antenna 20 to the housing 12.

The mounting of connector 26 to the fixed connector 80 for initial purposes, may be considered a two step procedure. Looking to FIG. 5, the initial step in this procedure is illustrated. In the figure, the threaded coupling portion 46 of clamp 28 is seen threadably engaged with the corresponding engaging region 64 of connector sleeve 32. Such threaded engagement, however, is not to the extent of such relative motion between these components 28 and 32 which would utilize the full threaded expanse of either portion 46 or region 64. It may be noted, however, that the compression shoulder 48 of clamp 28 has engaged the corresponding compression surface 54 of insulative spacer 52 such that the aligning collar 58 thereof has commenced to be inserted along with conductor lead or pin 50 into the fixed connector 80. In this regard, note that an annular passageway 92 receives the collar 58, while a centrally-positioned conductive receiver 94 receives the pin type conductive lead 50. Additionally in this orientation, the contact shoulder 56 is spaced from the end surface 86 of connector 80 and the bayonet pins 88 and 90 have made contact with corresponding ramp surfaces 68 and 70 of ramp assemblage 66. Additionally, it may be observed that the end surface 76 of connector sleeve 32 is in contact with the upwardly disposed surface of flange 84 of the fixed connector 80. While the above-described orientation of the various components of the connector 26 provides for an effective coupling of the antenna 20 with the housing 12 through the bayonet fixed connector 80, the next step in the procedure provides a highly desirable rigid coupling system.

Figure 6:
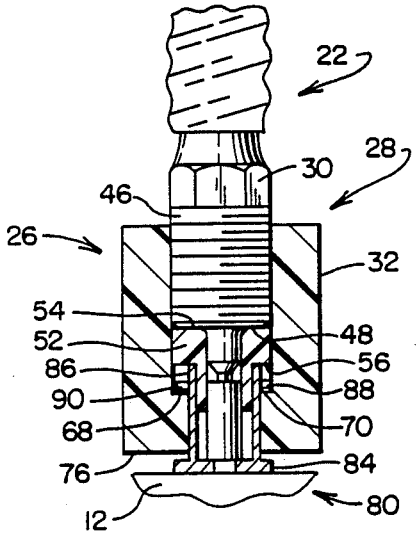
FIG. 6 is a sectional view of the connector of FIG. 5 showing the orientation of components thereof following the completion of connection procedures.

Referring to FIG. 6, the latter procedure completing the mounting for desired rigidity is portrayed. In this regard, by rotating the clamp 28 while retaining the connector sleeve 32 in a stationary posture, compression shoulder 48 of the clamp 28 will engage compression surface 54 of spacer 52 to, in turn, urge the oppositely disposed contact shoulder 56 thereof in to engagement with end surface 86 of fixed connector 80. Simultaneously, the ramps 68 and 70 of the connector sleeve 32 are pulled upwardly such that the bayonet pins 88 and 90 will tend to slightly deform the polymeric material of connector 32 to derive a more permanent form of connection. This latter, more permanent form of connection permits removal of the antenna 22, however, serves to resist any disconnection or loosening due to vibrationally induced rotation of the sleeve 32. Note that the deformation is evidenced by the lifting of end surface 76 of connector sleeve 32 from the upwardly disposed face or surface of flange 84 of fixed connector 80. With this arrangement, no relative movement is permitted between the antenna 22 or its connector 26 and the fixed connector 80.

Figure 7:
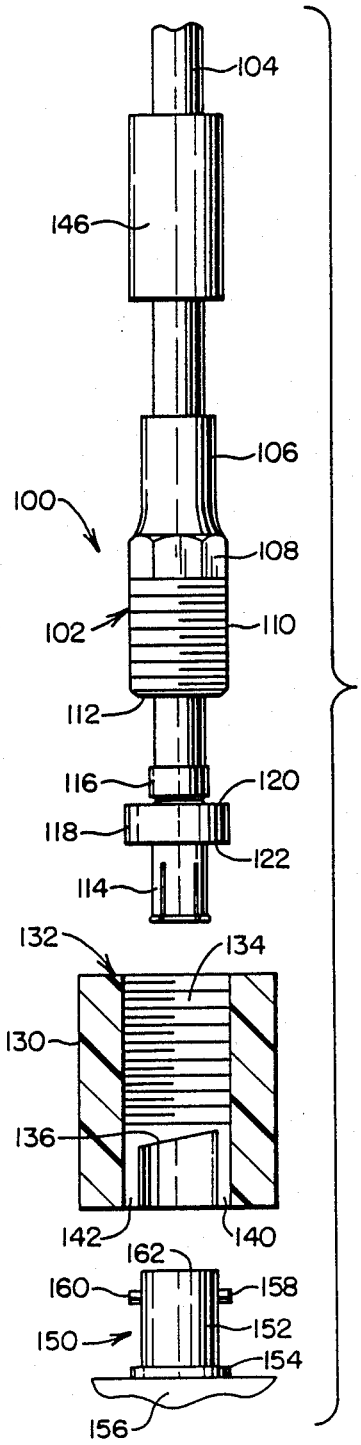
FIG. 7 is an exploded and partially sectional view of an embodiment of the connector of the invention suited for coaxial cable connection.

Turning to FIG. 7, the connector approach of the instant invention is shown as applied to an embodiment for coupling a conventional coaxial cable with a bayonet-type fixed connector. This connector, as represented generally at 100, is shown including a support represented generally at 102 which is configured in generally cylindrical form as having an internally disposed cylindrical channel extending therethrough which is configured to nestably receive a coaxial cable 104. Clamp 102, as before, is configured as having an optional support portion 106 which extends downwardly to a polygonal tool engagement surface 108, and thence to a coupling portion 110. The clamp 102 is shown terminating in a compression shoulder 112.

Cable 104 extends to a coaxial connector 14 of conventional design which includes an outer shell and within which is positioned a centrally disposed conductor pin of the conductor lead assemblage. The latter pin (not shown) is typically sheathed within a dielectric material. The connector is retained by a ferrule 116 providing for a compressive engagement with cable 104. Intermediate the connector 114 and ferrule 116 is a cylindrical sleeve 118 having a compression surface 120 and an oppositely disposed contact shoulder 122.

Next in the assemblage is a cylindrical connector sleeve 130 having a cylindrical centrally disposed passageway 132 extending therethrough and within which initially is disposed an engaging region 134. Region 134 comprises internal screw threads configured for threadable engagement with the corresponding threads of coupling portion 110 of clamp 102. Connector sleeve 130 additionally is configured having two integrally formed and oppositely disposed ramps defined by ramp surfaces 136 and 138 (FIG. 8) which, as before, are accessed by respective channels or slots 140 and 142. Connector sleeve 130 and, accordingly, the ramp surfaces 136 and 138 may be provided as formed of a polyamide or other suitable electrically insulative polymeric material. The connector 100, as thus described, is completed by the positioning of a protective polymeric sheath 146 over coaxial cable 104 such that it is additionally nestable over support portion 106.

Connector assembly 100, as before, is configured to be positioned over a conventional bayonet-type fixed connector Represented generally at 150 and including the cylindrical support shell 152 incorporating an annular flange 154 and which is fixed to the housing 156 of some given electrical device. Additionally, bayonet type pins or engaging components 158 and 160 extend from the shell 152 which includes an end surface 162. A centrally disposed conductive receiver suited for coaxial connection is positioned within the shell 152. The bottom surface of connector sleeve 130 provides an end surface as represented at 144.

Figure 8:
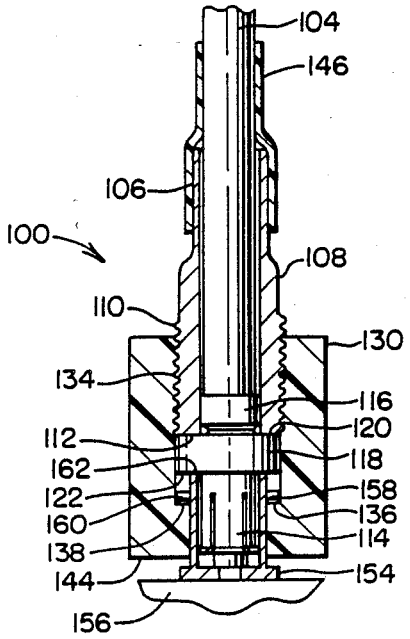
FIG. 8 is a sectional view of the connector of FIG. 7 showing the orientation of components thereof following final coupling procedures.

Referring to FIG. 8, the connector 100 is shown in its final, rigid coupled orientation. In the figure, the compression shoulder 112 of clamp 102 is shown in abutting compressive contact with the corresponding compression surface 120 of spacer 118. Correspondingly, the oppositely disposed contact shoulder 122 of spacer 118 is compressively positioned against corresponding end surface 162 of fixed connector 150. This has caused the movement of connector sleeve 130 upwardly away from flange 154 of fixed connector 150 and the formation of a detent engagement of bayonet pins 158 and 160 with corresponding deformable ramp surfaces 136 and 138. Thus, the highly rigid and desirable connection is made for this coaxial form of embodiment.

Figure 9:
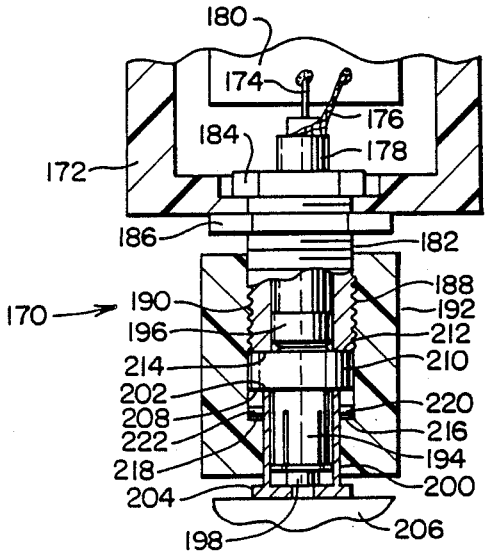
FIG. 9 is a sectional view of another embodiment for a connector according to the invention as applied to coaxial cable.

Referring to FIG. 9, another connector assemblage for the coaxial embodiment is shown generally at 170. This assemblage is shown as employed for the connection of one housed circuit component to another one. For example, a circuit box is shown at 172 having coaxial leads 174 and 176 extending from a coaxial lead or cable 178 to a circuit board 180. Cable 178 in turn, is supported by a threaded connector 182 secured, in turn, by hex nut 184 and hex backing nut 186 to box 172. Threaded connector 182 corresponds with a clamp as at 102. In this regard, the connector 182 includes a coupling portion 188 which is seen to be threadably engaged with corresponding teeth of the thread array of an engaging region 190 of connector sleeve 192. As before, the coaxial structure 178 is terminated in a coaxial connector assemblage 194 which is retained upon the coaxial component 178 by ferrule 196. Connector 194 is seen to be positioned over the center, centrally disposed conductive receiver 198 of a bayonet-type fixed connector 200, having an end surface 202 and outwardly-extending flange 204. The connector is shown fixed to the housing 206 of a next adjacent electrical implement. As before, the end surface 202 of connector 200 is positioned adjacent and in compression against the contact shoulder 208 of a spacer 210. Spacer 210, in turn, is compressed by virtue of the compressive contact of its compression surface 212 with the corresponding compression shoulder 214 of the threaded connector 182. Connector sleeve 192, as before, is configured having oppositely disposed internal ramps as at 216 and 218 which are accessed by respective bayonet connector pins 220 and 222. Pins 220 and 222 are deformed into the polymeric sleeve material upon effecting the noted tightening of the threaded connector 182. Access to the pins 220 and 222 is by channels or slots (not shown) as described in conjunction with the earlier embodiments of the connector of the invention.

Figure 10:
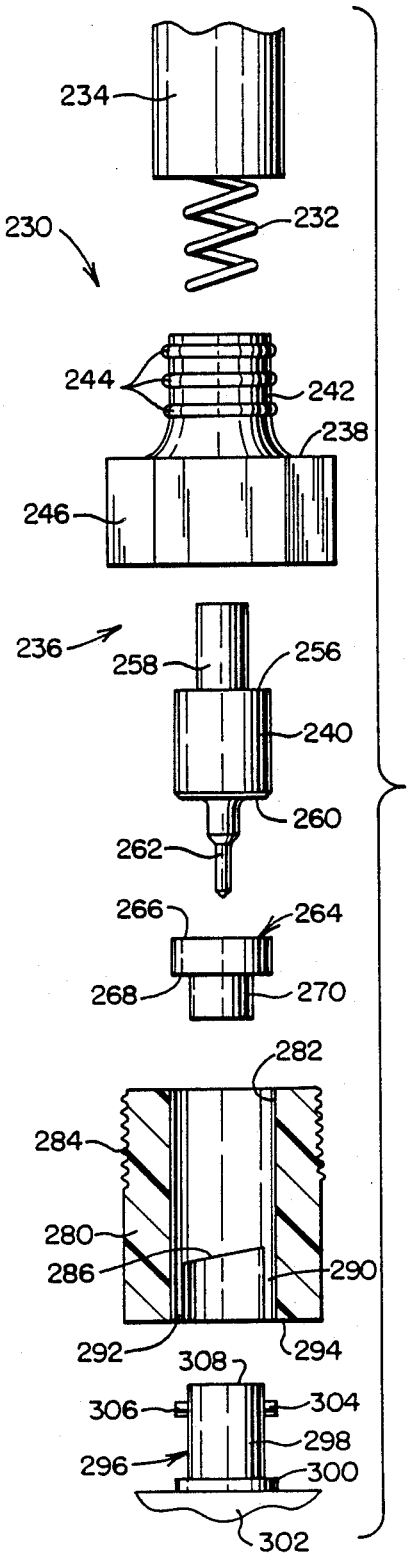
FIG. 10 is an exploded and partially sectional view of another embodiment of a connector according to the invention.
Figure 11:
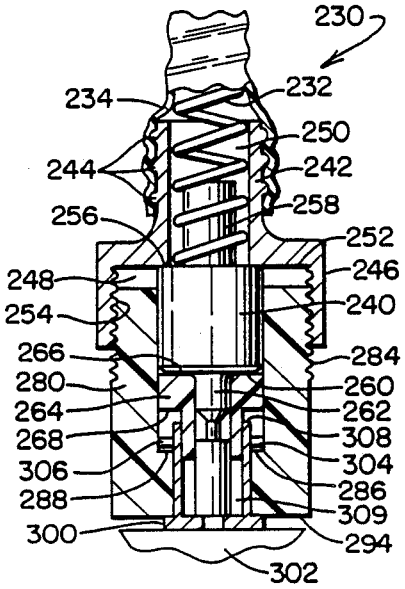
FIG. 11 is a sectional view of the connector of FIG. 10 showing the orientation of components thereof at a preliminary stage in the procedure of mounting the connector.

Turning to FIG. 10, another embodiment for the connector of the invention is represented generally at 230. This connector is suited for mounting an antenna or a coaxial cable as discussed in conjunction with FIGS. 7 and 8 above. Connector 230 is depicted in operative association with a helical wire antenna 232, shown having a plastic sheath 234 positioned thereover prior to the carrying out of attachment by shrink wrap procedures. The support clamp assemblage of connector 230 is represented generally at 236 as including a retainer collar 238 and a stud component 240. Retainer collar 238 is seen formed having an upwardly or rearwardly disposed support portion or neck 242 which is provided containing ridges 244 for enhancing its coupling with the plastic sheath 234. Collar 238 additionally includes a polygonal tool engagement surface 246, however, because of the more expansive diametric extent of this surface, for many installations, it may be hand grasped to effect tightening of the collar 238. Looking momentarily to FIG. 11, it may be observed that retainer collar 238 is formed having a centrally disposed cylindrical cavity 248 located internally of the surface 246, as well as a cylindrical passageway 250 within which the helical antenna 232 may be positioned. Cavity 248 terminates in an abutting surface 252 and is seen to contain an internally disposed coupling portion 254.

Returning to FIG. 10, the stud 240 is seen to include an upwardly disposed contact surface 256 from which extends a mounting stud 258 forming part of the rearward support and intended to connectably receive the lower portion of helical spring antenna 232. Stud component 240 also includes a compression shoulder 250 from which depends a conductive lead 262 having the earlier-discussed pin configuration.

Next in the assemblage is a polymeric spacer shown at 264 and configured as spacer 52 described in conjunction with FIG. 4 to include a compression surface 266, a contact shoulder 268, and an aligning collar 270. A cylindrical passageway (not shown) extends through the spacer 264 for purposes of receiving the conductive lead 262 extending from stud component 240.

The connector sleeve 280 of connector 230 preferably is formed of an electrically insulative polymeric material, for example a polyamide such as "Nylon". The sleeve 280 is formed having the centrally disposed passageway 282 therein and the outer cylindrical surface thereof is formed to provide a threaded cylindrical engaging region 284, the threads of which are engageable with the internally-disposed threads of coupling portion 254 of collar 246. As before, the connector sleeve 280 is configured having oppositely disposed integrally formed ramps 286 and 288 (FIG. 11) as well as two oppositely disposed channels or slots 290 and 292. Terminating in an end surface 294, the connector sleeve 280 is positionable over bayonet-type fixed connector 296, which is seen to include a cylindrical support shell 298 integrally formed with a flange 300 and affixed to the housing of an electrical device 302. Cylindrical shell 298 is formed having oppositely disposed bayonet pins 304 and 306 and extends to an end surface 380.

Returning to FIG. 11, the operational aspects of the connector 230 are revealed. The figure represents an orientation of components for an initial closure procedure similar to that discussed in conjunction with FIG. 5. In this regard, it may be observed that the stud component 240 is positioned within cavity 248 of retainer collar 238. As such, the abutting surface 252 within the internal cavity 248 of collar 238 engages and compressively abutts against the corresponding contact surface 256 of stud component 240. This urges the corresponding compression shoulder 260 of stud component 240 into compressive engagement with the corresponding compression surface 266 of spacer 264. The assemblage thus is driven such that the aligning collar 270 of spacer 264, as well as the pin type conductive component 262 are urged into union with corresponding receiver components of fixed connector 296. As before, the collar 270 slides within the passageway 309 of connector 296. At this juncture, the end surface 294 of sleeve component 280 has not made contact with the flange 300 of connector 296. Similarly, the contact shoulder 268 of spacer 264 has not contacted the end surface 308 of connector 296. However, by the simple and conventional expedient of making the bayonet connection by rotating connector sleeve 280, bayonet pins 304 and 306 have contacted and ridden upwardly upon corresponding ramps 286 and 288. Thus, a conventional first connection has been made.

Figure 12:
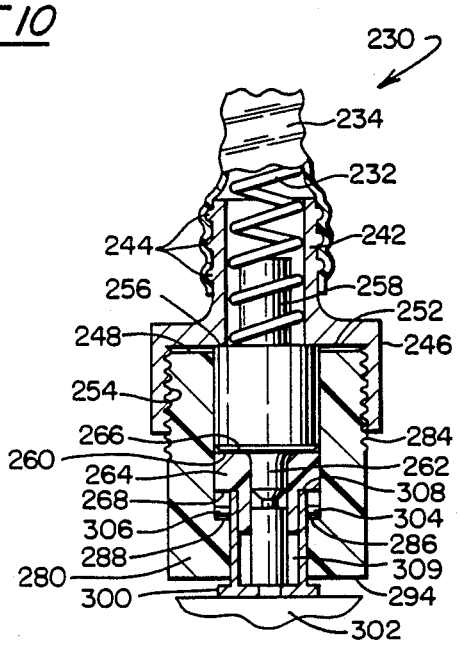
FIG. 12 is a sectional view of the connector of FIG. 11 showing the orientation of components thereof following final mounting procedures.

Turning to FIG. 12, upon rotation of retainer collar 238 (FIG. 10), for example by hand, the abutting surface 252 has further stud 240 downwardly by virtue of its contact against contact surface 256 thereof. Correspondingly, the compression shoulder 260 of stud 240 has, in turn, driven spacer 264, by contact against compression surface 266 thereof, downwardly. This downward movement of spacer 264 continues until abutting compressive contact is made between contact shoulder 268 and the end surface 308 of fixed connector 296 (FIG. 10). The result is a rigid tightening of the connector assembly 230 such that the bayonet pins 304 and 306 tend to deform the polymeric material forming corresponding ramps 286 and 288 to prevent, for example, vibration induced rotation and release of the connection. Note that with this tightening, surface 294 of connector sleeve 280 has elevated above flange 300 of connector 296.

Figure 5:
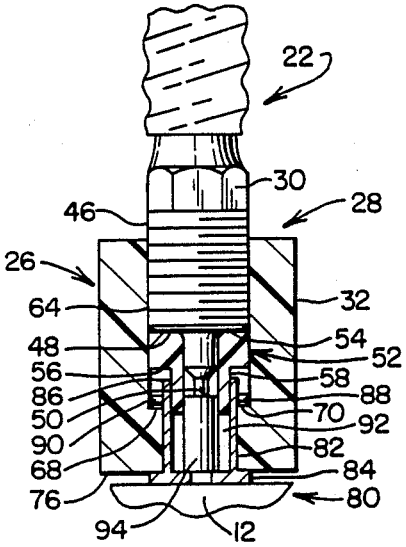
FIG. 5 is a sectional view of the connector of FIG. 4 showing the orientation of components during a preliminary coupling procedure.

A connector configured as described in conjunction with FIGS. 4 through 6 hereof was tested by coupling it in a vertical orientation to a support upon which was fixed a connector as described at 80. The antenna assemblage was about 6½ inches in height. A striker arm of diameter of 6½ inches was coupled to a motor driven shaft and positioned to strike the antenna at an elevation of 5 inches from its base under a shaft rotational speed of 580 rpm. Nylon material was used for the connector sleeve of the tested device as described as 32 herein. Following the energization of the motor and rotation of the noted shaft and strike arm, following 15 minutes and 11 seconds of operation, representing 8,806 impacts, the test was concluded, inasmuch as the helical spring of the antenna had bent below the strike arm's rotational plane. The nylon connector sleeve 32 remained in firm, tight, undamaged relationship with its associated fixed connector as described at 80 in conjunction with FIG. 4. Similar tests carried out with standard BNC connectors, for example provided as Amphenol type 31-2-4051 devices experienced damage under the same test arrangement following motor energizations of three seconds with 29 impacts and two minutes and seven seconds with 1,228 impacts with the striker arm.

Since certain changes may be made in the above-described apparatus without departing from the scope of the invention herein involved, it is intended that all matter contained in the description thereof or shown in the accompanying drawings shall be interpreted as illustrative and not in a limiting sense.

I claim:

1. A connector for mounting an electrical transmission component to a bayonet-type fixed connector having a cylindrical support shell, an end surface, oppositely disposed bayonet pins and surrounding a centrally disposed conductive receiver, comprising:

a support clamp having a rearwardly disposed support portion for supporting said electrical transmission component, a coupling portion adjacent thereto, a compression shoulder and conductive leads means electrically communicating with said transmission component for removable connection with said conductive receiver;

a spacer having a compression surface configured for receiving said compression shoulder in force transmitting communication, and an oppositely disposed contact shoulder;

a connector sleeve having a cylindrical passageway extending therethrough, said connector sleeve being configured having an engaging region for receiving and engaging said support clamp coupling portion in compression deriving connection upon relative movement therebetween, said passageway including internally disposed ramp means having oppositely disposed ramp contact surfaces for engagement with said bayonet pins, channel means for accessing said bayonet pins with said ramp contact surfaces upon positioning of said passageway over said fixed connector cylindrical support, said channel means extending to an end surface;

whereby, said connector sleeve, upon rotation, is drawn toward said bayonet-type fixed connector by said connector sleeve ramp contact surfaces engagement with said bayonet pins to effect connection of said fixed connector conductive receiver and said conductive lead, and upon relative movement of said support clamp and said connector sleeve, said ramp contact surfaces and said bayonet pins are urged into enhanced compressive engagement.

2. The connector of claim 1 in which:

said support clamp coupling portion and said connector sleeve engaging region are mutually threadably engaged.

3. The connector of claim 2 in which said connector sleeve ramp means ramp contact surfaces are provided as a compressively deformable polymeric material for defining a detent-like engagement with bayonet pins upon their compressive engagement.

4. The connector of claim 1 in which said spacer contact shoulder is configured for movement into abutting compressive engagement with said fixed connector end surface when said relative movement between said support clamp and said connector sleeve occurs.

5. The connector of claim 1 in which:

said support clamp coupling portion comprises a first threaded region located at an external surface of said clamps;

said connector sleeve engaging region comprises a second threaded region within said passageway and threadably engageable with said first threaded region.

6. The connector of claim 5 in which said support clamp includes a polygonal tool engagement surface means intermediate said support portion and said coupling portion for tool engagement to effect the rotation of said support clamp.

7. The connector off claim 1 in which:

said support clamp includes a retainer collar having a cylindrically shaped internal surface defining a cavity therein, said clamp coupling portion comprising a first threaded region located at said internal surface, a stud component located centrally of said cavity and defining said support portion and extending to form said compression shoulder; and said connector sleeve engaging region comprises an externally disposed second threaded region, threadably engageable with said first threaded region.

8. The connector of claim 7 in which said support clamp retainer component includes polygonal tool engagement surface means for tool engagement to effect rotation thereof.

9. The connector off claim 7 in which said connector sleeve ramp means ramp contact surfaces are provided as a compressively deformable polymeric material for deriving a detent-like engagement with bayonet pins upon their compressive engagement.

10. The connector of claim 1 in which said connector sleeve is of cylindrical shape and formed of a polyamide.

11. The connector of claim 1 in which said spacer is a cylindrical configuration, is formed of an electrically insulative polymeric material, and includes a cylindrical aligning collar integrally formed therewith and mountable over said fixed connector centrally disposed conductive receiver.

* * * * *